US005153949A

United States Patent [19]

Karlsson

[11] Patent Number: 5,153,949

[45] Date of Patent: Oct. 13, 1992

[54] PUMP ARRANGEMENT FOR HYDROMASSAGE BATHS

[75] Inventor: Göte Karlsson, Växjö, Sweden

[73] Assignee: Perfecta Pump Aktiebolag, Vaxjo, Sweden

[21] Appl. No.: 655,397

[22] PCT Filed: Aug. 16, 1989

[86] PCT No.: PCT/SE89/00433

§ 371 Date: Feb. 14, 1991

§ 102(e) Date: Feb. 14, 1991

[87] PCT Pub. No.: WO90/01917

PCT Pub. Date: Mar. 8, 1990

[30] Foreign Application Priority Data

Aug. 16, 1988 [SE] Sweden ..... 8802908

[51] Int. Cl.[5] ..... A61H 33/02

[52] U.S. Cl. ..... 4/541.4

[58] Field of Search ..... 4/542, 544, 541

[56] References Cited

U.S. PATENT DOCUMENTS

| | | | |
|---|---|---|---|
| 2,529,255 | 11/1950 | Jobe | 4/542 |
| 3,523,525 | 8/1970 | Vanegas et al. | 128/66 |
| 4,420,846 | 12/1983 | Bonner | 4/542 |
| 4,602,391 | 7/1986 | Shepherd | 4/542 |
| 4,726,080 | 2/1988 | Henkin et al. | 4/544 X |
| 4,797,958 | 1/1989 | Guzzini | 4/542 |

FOREIGN PATENT DOCUMENTS

| | | | |
|---|---|---|---|
| 3544002 | 6/1987 | Fed. Rep. of Germany . | |
| 100035 | 6/1988 | Japan | 4/544 |

OTHER PUBLICATIONS

Aqua Industry Guide 1990 p. 306 Dec 1989.

*Primary Examiner*—Charles E. Phillips

*Attorney, Agent, or Firm*—Roylance, Abrams, Berdo & Goodman

[57] ABSTRACT

A pump arrangement for jacuzzi baths including a centrifugal pump having a central inlet and a radial outlet and a pipe system connected to the inlet by means of an inlet pipe and an outlet. The pump arrangement also includes means for introducing air into the output pipe. The capacity of the pump can be adjusted by means of a control arrangement comprising an air pipe provided with a valve and operative in passing air into the inlet pipe. When the valve is opened so that a large quantity of air will enter the pump, both the amount of water pumped by the pump and the pump outlet pressure will decrease as a result thereof.

12 Claims, 1 Drawing Sheet

FIG. 1

FIG. 1
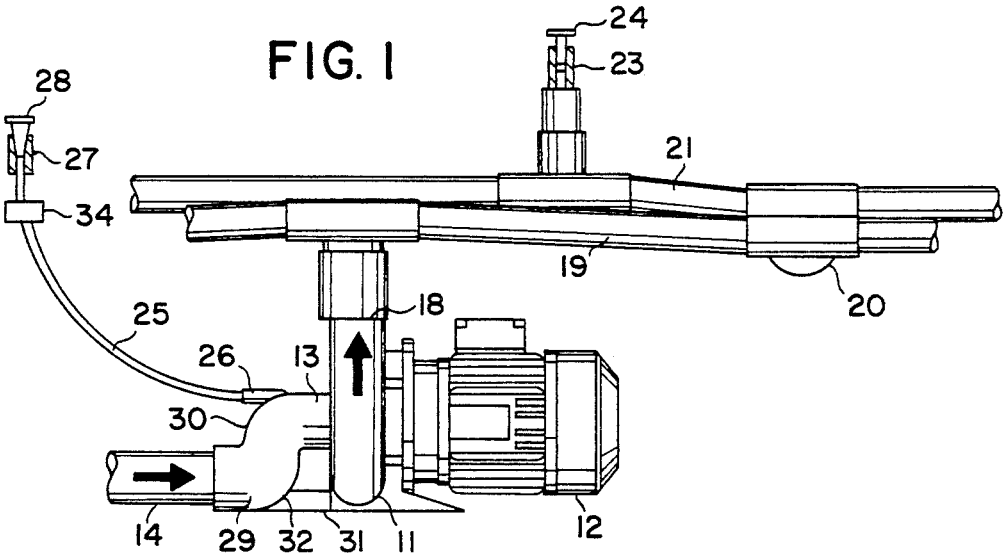
FIG. 3
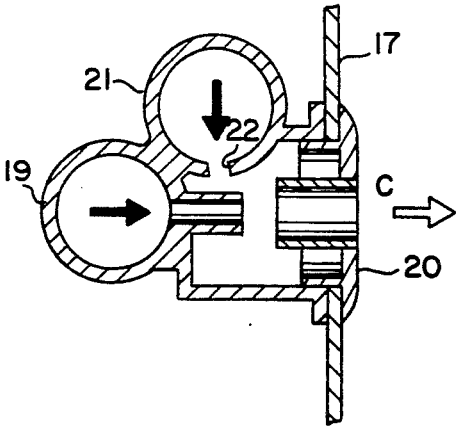
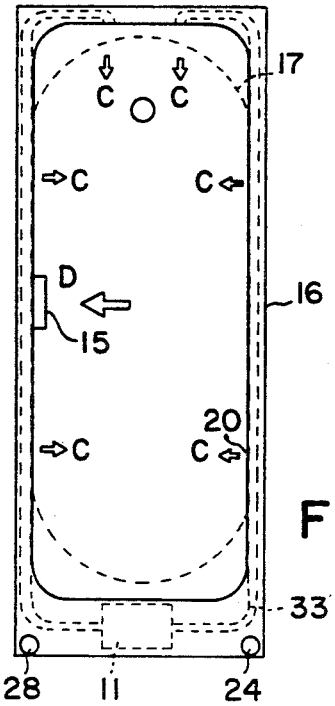
FIG. 2

PUMP ARRANGEMENT FOR HYDROMASSAGE BATHS

The present invention relates to a pump arrangement intended for hydromassage baths and comprising a centrifugal pump having a central inlet and a radial outlet, a pipe system which is connected to the inlet and the outlet of said pump and which includes an inlet and an outlet pipe operative to circulate water through the pump and discharging into said bath, and further comprising means for introducing air into the outlet pipe.

Pump arrangements intended for hydromassage baths have hitherto lacked means for controlling or regulating the capacity of the pump, i.e. the pumps are constructed to circulate constantly a given, determined quantity of water. The quantity of air that is delivered to the outlet water, on the other hand, can be regulated with the aid of adjustable valves provided for this purpose. Such adjustments, however, have very little effect on pump capacity. It has been found that different people have pronounced differences of opinion as to what water jet pressures are the most pleasant or comfortable. For instance, many people consider the pressure of such jets to be too high and that the bath water becomes too "violent", particularly when remaining in the bath for long periods of time. Small children also appreciate the opportunity of bathing in flowing water under circumstances which do not exclude the possibility of indulging in normal play activities. Consequently, there is a need for the possibility of enabling the pump capacity to be lowered both before and when taking a bath. One possible solution in this regard is to regulate the speed of the pump motor in a known manner. This solution would be too costly, however, and also insuitable in view of the environment in which such baths are normally installed. Consequently, no such constructions are used in practice.

Accordingly, an object of the present invention is provide a pump arrangement with which the rate of flow of water through said arrangement can be controlled or regulated readily, in a manner adapted to hydromassage baths. Further objects and advantages afforded thereby will be apparent from the following description. These objects and advantages are achieved with an inventive pump arrangement having the characterizing features set forth in the following claims.

The invention is based on the concept that the capacity of a centrifugal pump can be influenced, by introducing air into the suction side thereof, such as to displace a corresponding volume of water. Although this will lower the efficiency of the pump and engender the presence of air bubbles on the pressure side of said pump, such occurrencies are not disadvantageous in the case of hydromassage applications, since the water is nevertheless intended to be admixed with air and the capacity of the pump used is normally sufficient for the purpose intended. This control can be effected readily, by providing an air pipe which is fitted so as to discharge in the vicinity of the pump inlet and which incorporates an appropriate adjustable air valve wherewith the pump capacity will decrease with increasing valve-open positions.

The invention will now be described in more detail with reference to the accompanying drawing, in which FIG. 1 is a side view of an inventive pump arrangement;

FIG. 2 is a view from above of a hydromassage both fitted with the inventive pump arrangement; and FIG. 3 is a cross-sectional view of an outlet nozzle fitted to the bath.

The illustrated pump arrangement comprises a conventional centrifugal pump 11 which is driven at a constant speed by a pump motor 12. The pump inlet 13 is connected to an inlet pipe 14, which has an intake 15 located in the wall 17 of a bath 16. The outlet 18 of the pump is connected to an outlet pipe 19 which extends around the wall 17 of the bath and which has provided therealong a multiple of nozzles 20. The nozzles 20 are fitted into the wall 17 of the bath, in a manner to direct water jets C into the bath interior. In order to achieve the desired air/water admixture in the outlet pipe 19, or more specifically in the nozzles 20, an air pipe 21 is disposed along the outlet pipe 19. The air pipe 21 is provided with an air outlet 22 which coacts with respective nozzles 20, in which air is admixed with the water in the outlet pipe 19 in a known manner. The amount of air drawn into the pipe and admixed with the water is controlled by means of an air valve 23 provided with appropriate valve setting means 24.

The pump capacity control arrangement includes an air conduit 25 whose outlet opens into a pipe connector 26 fitted to the pump in the proximity of the pump inlet 13. The air conduit is fitted with a valve 27 which can be opened to a greater or lesser extent by means of valve setting means 28. The pipe connector 26 forms part of an S-shaped elbow pipe 29, which in turn forms the connection of the inlet pipe 14 to the pump 11. As shown in the drawing, the pipe connector 26 extends from the upper pipe-bend 30 of the elbow pipe 29 located nearest the pump, whereas a second pipe connected 31 extends from the lower pipe-band 32 located nearest the pump supporting surface. The latter pipe connector 31 is connected to the pump housing and is operative in draining all water from the pump when the pump is not in use. The pipe elbow 29 is manufactured from a flexible, polymeric material which enables the connections to be readily made and which has a vibration damping effect. In order to achieve desired adjustment of the pump capacity down to a level of about 25% of the full pump capacity, the internal diameter of the air pipe 25 should be between 1/15 and 1/7 of the internal diameter of the inlet pipe 14, which in respect of standard fittings means that the air pipe will have a diameter of only 2–5 mm. By connecting the air pipe 25 close to the pump inlet 13 it is ensured that the capacity of the pump can be adjusted without unnecessary delay, and the valve setting means 24 and 28 are preferably mounted on the upper rim 33 of the bath, so as to be readily accessible to a person seated therein.

The invention provides a highly reliable and positive solution to the control of pump flow in normal, standard pump arrangements intended for hydromassage baths. Thus, the invention will enable a normal flow of about 150–200 l/min to be readily reduced to a quarter of this flow rate to no disadvantage and to enable the flow rate to be adjusted optionally to values therebetween.

It will understood that the described and illustrated pump arrangement does not limit the scope of the invention and that other embodiments are conceivable within the scope of the following claims. For example, the valve can be controlled with the aid of a small electric motor 34 operative in causing the valve to be constantly adjusted to different opening positions, such as to generate a pulsating flow of water. Mutually different flows can be generated continuously, by switching off the motor in different positions. This motor may be arranged in the vicinity of the pump inlet 13, e.g. in direct connection with the pipe connector 26 or a shorter air pipe 25. The motor control devices, however, should be positioned in the manner of the illustrated valve setting means 28.

I claim:

1. A pump arrangement intended for hydromassage baths comprising a centrifugal pump having a central inlet and a radial outlet, an inlet pipe connected to said inlet and an outlet pipe connected to said outlet for circulating bath water, means for admixing a first source of air with water in the outlet pipe, an adjustable air intake connected to said central inlet by an air pipe for controlling a second source of air which thereby controls the water capacity of said pump, the ratio between an inner diameter of said air pipe and said inlet pipe is in the range of 1:15 to 1:7, wherein both the amount of water pumped by said pump and the outlet pressure will decrease with increasing degrees of opening of the air intake.

2. A pump arrangement according to claim 1, characterized in that the air intake includes said air pipe being provided with a valve and an outlet opening in the close vicinity of the pump inlet, and in that the valve is operative to adjust the capacity of said pump.

3. A pump arrangement according to claim 1, characterized in that the capacity of the pump can be adjusted to levels ranging from 100% and 25% full pump capacity, by adjusting the extend to which the air intake is opened.

4. A pump arrangement according to claim 3, characterized in that the pump is driven at a constant speed and to generate a maximum flow of 150–200 l/min.

5. A pump arrangement according to claim 4, characterized in that the pump inlet pipe is terminated with a separate S-shaped pipe elbow, and in that a pipe connector for connection to the air pipe is located on a pipebend of said elbow nearest the pump inlet.

6. A pump arrangement according to claim 5, characterized in that a pipe bend of said pipe elbow located nearest a pump supporting surface has a second pipe connector connected to the interior of the pump for draining water therefrom.

7. A pump arrangement according to claim 6, characterized in that the outlet pipe extending from the pump is connected to a multiple of nozzles fitted to the wall of the bath, said nozzles including said means for the admixture of said first source of air with outlet water.

8. A pump arrangement according to claim 7, wherein said air pipe includes a valve and valve setting means for regulating pump capacity and said means for admixing air with said outlet water includes a valve and valve setting means to control the extend to which air is admixed with the outlet water, said valves and valve setting means being fitted to an upper rim of the bath.

9. A pump arrangement according to claim 8, comprising an automatic control means operative to control the opening extent of the air intake continuously between two levels, whereby said pump generates a pulsating water flow.

10. A centrifugal pump for use in a hydromassage bath comprising:

a central inlet;

an outlet pipe connected to said central inlet;

an inlet pipe connected to said radial outlet for circulating water through a bath;

first adjustable air intake means connected to said central inlet to introduce air to said pump and selectively adjust pump capacity and the amount of water pumped;

second adjustable air intake means for introducing and mixing air in said outlet pipe;

automatic control means connected to said first air intake means for cyclically opening and closing said air intake means whereby said pump generates a pulsating pump pressure and water flow.

11. The pump according to claim 10, and further comprising nozzle means connected to said outlet pipe, and first adjustable valve means connected to said first air intake means to selectively adjust the amount of air introduced to said pump and said nozzle.

12. The pump according to claim 11, and further comprising second adjustable valve means connected to said second air intake means to selectively adjust the amount of air introduced to said outlet pipe.

* * * * *